US009891576B2

(12) United States Patent
Hayashida et al.

(10) Patent No.: US 9,891,576 B2
(45) Date of Patent: Feb. 13, 2018

(54) FEEDING DEVICE, CLEANING DEVICE, PROCESS CARTRIDGE AND IMAGE FORMING APPARATUS

(71) Applicant: CANON KABUSHIKI KAISHA, Tokyo (JP)

(72) Inventors: Makoto Hayashida, Numazu (JP); Toshiaki Takeuchi, Susono (JP); Akinobu Hirayama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/054,308

(22) Filed: Feb. 26, 2016

(65) Prior Publication Data

US 2016/0252849 A1 Sep. 1, 2016

(30) Foreign Application Priority Data

Feb. 27, 2015 (JP) ..... 2015-037861

(51) Int. Cl.

*G03G 21/00* (2006.01)
*G03G 21/10* (2006.01)
*G03G 15/08* (2006.01)

(52) U.S. Cl.

CPC ..... *G03G 21/0011* (2013.01); *G03G 15/0891* (2013.01); *G03G 21/0029* (2013.01); *G03G 21/10* (2013.01); *G03G 21/105* (2013.01)

(58) Field of Classification Search

CPC .. G03G 21/10; G03G 21/105; G03G 21/0005; G03G 21/0011; G03G 21/0029; G03G 15/0891; G03G 21/12

See application file for complete search history.

(56) References Cited

U.S. PATENT DOCUMENTS 9,383,714 B1 * 7/2016 Sato ..... G03G 15/161
2010/0300484 A1 * 12/2010 Gumbe ..... G03G 21/007 134/6

(Continued)

FOREIGN PATENT DOCUMENTS

JP 2001-042736 A 2/2001
JP 2006-139084 A 6/2006

(Continued)

OTHER PUBLICATIONS

Machine translation of JP 2006-139084. Jun. 1, 2006.*

(Continued)

*Primary Examiner* — Carla Therrien
(74) *Attorney, Agent, or Firm* — Fitzpatrick, Cella, Harper & Scinto

(57) ABSTRACT

A developer feeding device includes a cleaning member contacted to an image bearing drum; a accommodating portion for the developer removed by the cleaning member; a feeding member for feeding the developer from the accommodating portion; a sheet contacted to the drum; and a guide forming a part of a wall surface of the accommodating portion at a position in a side of the sheet with respect to a line connecting a drum center and a feeding member center, as seen in a drum axis direction. The guide extends in a acute angle range formed between a first line extending vertically through the feeding member center and a second line extending in a direction of a rest angle of the developer through the feeding member center, the guide having a shape such as to approach to a linear shape as a distance of the feeding member decreases.

16 Claims, 5 Drawing Sheets

(56) References Cited

U.S. PATENT DOCUMENTS

2010/0303479 A1* 12/2010 Itoh ..... G03G 21/12
399/21
2014/0356043 A1* 12/2014 Tokuda ..... G03G 21/105
399/358

FOREIGN PATENT DOCUMENTS

JP 2012-128250 A 7/2012
JP 2015022199 A * 2/2015

OTHER PUBLICATIONS

Machine Translation of JP2015-022199. Feb. 2015.*
Extended European Search Report dated Jun. 30, 2016, in Application No. 16157570.9.
U.S. Appl. No. 15/049,735, filed Feb. 22, 2016.

* cited by examiner

FEEDING DEVICE, CLEANING DEVICE, PROCESS CARTRIDGE AND IMAGE FORMING APPARATUS

FIELD OF THE INVENTION AND RELATED ART

The present invention relates to a feeding device, a cleaning device, a process cartridge, and an image forming apparatus.

Here, a process cartridge is a cartridge equipped with at least an image bearing member such as an electrophotographic photosensitive drum, or a cartridge equipped with both an image bearing member and processing means for processing the image bearing member. These types of cartridge are removably installable in the main assembly of an image forming apparatus.

An example of cartridge which can be listed as a process cartridge is a cartridge which integrally holds an electrophotographic photosensitive drum, and at least one of the abovementioned processing means, more specifically, a developing means, a charging means, and a cleaning means. Further, an electrophotographic image forming apparatus is an apparatus which forms an image on a recording medium with the use of an electrophotographic image forming method.

Examples of electrophotographic image forming apparatus include an electrophotographic copying machine, an electrophotographic printer (LED printer, laser beam printer, and the like), an electrophotographic facsimile machine, an electrophotographic word processing machine, etc.

An image forming apparatus 100 such as an electrophotographic printer which uses an electrophotographic process forms an image on a recording medium through the following steps. That is, it uniformly charges a photosensitive drum, which is an image bearing member, and forms a latent image on the photosensitive drum by selectively exposing numerous points of the uniformly charged peripheral surface of the photosensitive drum. Then, it develops the latent image into a visible image (which hereafter may be referred to as toner image) with the use of toner (developing agent: developer), and transfers the image formed of developer (toner image) onto the recording medium. Further, it fixes the developer image to the recording medium by applying heat and pressure to the developer image on the recording medium.

Various processing means for an image forming apparatus such as those mentioned above have to be maintained. However, if an electrophotographic image forming apparatus is designed so that it employs a process cartridge, the apparatus can be maintained by a user himself or herself. Thus, an image forming apparatus designed to employ a process cartridge is significantly superior in terms of operational efficiency. Thus, a process cartridge is widely in use in the field of an electrophotographic image forming apparatus.

In the image forming operation of an image forming apparatus which uses an electrophotographic process, a certain amount of developer (toner) fails to be transferred from a photosensitive drum onto a recording medium, and remains on the photosensitive drum. Then, it is removed from the photosensitive drum by a cleaning member, and is stored as waste toner in the waste toner storage section of a cleaning unit. Then, the waste toner is conveyed by a feeding mechanism from the waste toner storage section to a replaceable waste toner box, which is externally attached to the cleaning unit (Japanese Laid-open Patent Applications Nos. 2006-139084, and 2012-128250).

SUMMARY OF THE INVENTION

However, an image forming apparatus such as those described above has an issue regarding how to ensure that the developer (waste toner) removed by a cleaning member is reliably guided to a feeding device. Thus, it has been desired that an image forming apparatus is improved to deal with this issue.

Thus, the primary object of the present invention is to provide a feeding device which is superior to any conventional feeding device in terms of reliability and efficiency with which the developer removed by a cleaning member is conveyed to a feeding device, and also, to provide a cleaning device, a process cartridge, and an image forming apparatus which employ such a feeding device.

According to an aspect of the present invention, there is provided a feeding device for feeding a developer, said feeding device comprising a cleaning member contacted to an image bearing member configured to carry a developer image to remove a developer from said image bearing member; an accommodating portion configured to accommodate the developer removed by said cleaning member; a feeding member configured to feed the developer from said accommodating portion; a sheet contacted to said image bearing member; and a guiding portion forming a part of a wall surface of said accommodating portion at a position in a side of said sheet with respect to a line connecting a rotation center of said image bearing member and a rotation center of said feeding member, as seen in a direction of an axial direction of said image bearing member; wherein said guiding portion extends in a acute angle range formed between a first line which extends vertically through the rotation center of the feeding member and a second line extending in a direction of an angle of rest of the developer through the rotation center of said feeding member, said guiding portion having such a shape so as to approach a linear shape as a distance of said feeding member decreases.

Further features of the present invention will become apparent from the following description of exemplary embodiments with reference to the attached drawings.

DESCRIPTION OF THE EMBODIMENTS

Embodiment 1

Hereinafter, an image forming apparatus and a process cartridge, which are in accordance with the present invention, are described with reference to appended drawings.

(Image Forming Apparatus)

Figure 2:
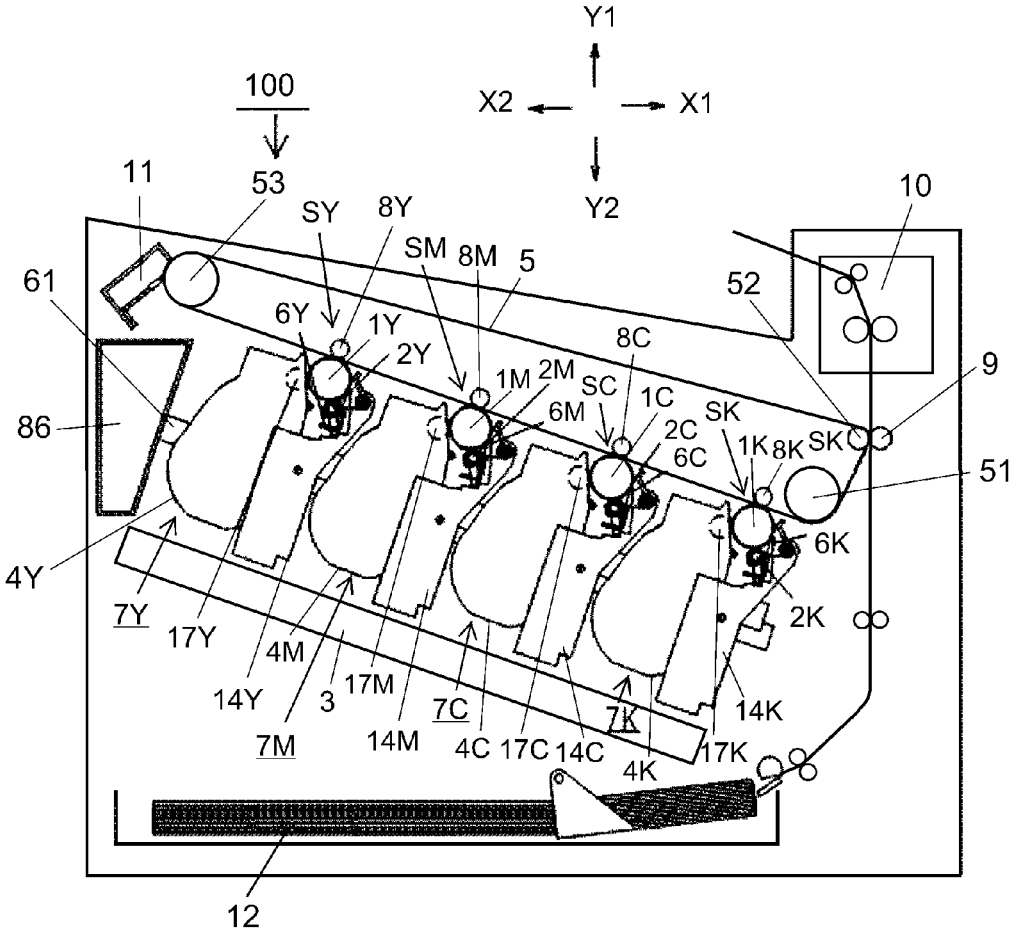
FIG. 2 is a schematic sectional view of the electrophotographic color image forming apparatus, in the first embodiment, equipped with the feeding device which is in accordance with the present invention.

To begin with, referring to FIG. 2, an electrophotographic color image forming apparatus equipped with a feeding device which is in accordance with the present invention is described about its overall structure. Referring to FIG. 2, which is a schematic sectional view of the apparatus, the image forming apparatus 100 has multiple image forming sections, more specifically, the first, second, third, and fourth image forming sections SY, SM, SC and SK for forming yellow (Y), magenta (M), cyan (C) and black (K) images, respectively. In this embodiment, the first to fourth image forming sections SY, SM, SC and SK are aligned in a single line in the direction which is intersectional to the vertical direction (indicated by arrow marks Y1 and Y2) in such an attitude that their lengthwise direction becomes intersectional to the vertical direction.

By the way, in this embodiment, process cartridges 7 (7Y, 7M, 7C and 7K) are practically the same in structure and operation, although they are different in the color of the image they form. Hereafter, therefore, suffixes Y, M, C and K are eliminated so that the four process cartridges 7 can be described together, unless they need to be differentiated. That is, in this embodiment, the image forming apparatus 100 has multiple image bearing members, more specifically, four photosensitive drums 1, which are aligned in a single line in the direction which is intersectional to the vertical direction, in such an attitude that their lengthwise direction become intersectional to the vertical direction. Each photosensitive drum 1 has also a charge roller 2 and a scanner unit 3 (exposing device), which are disposed in the adjacencies of the peripheral surface of the photosensitive drum 1 as an image bearing member for bearing a developer image.

Here, the charge roller 2 is a charging means for uniformly charging the peripheral surface of the photosensitive drum 1. The scanner unit 3 (exposing device) is an exposing means for forming an electrostatic image (electrostatic latent image) on the peripheral surface of the photosensitive drum 1 by projecting a beam of laser light upon the uniformly charged area of the peripheral surface of the photosensitive drum 1 while modulating the beam according to the information about the image to be formed. The process cartridge 7 is also provided with a developing device 4 (which hereafter will be referred to as development unit) and a cleaning blade 6 as a cleaning member (cleaning means), which also are disposed in the adjacencies of the peripheral surface of the photosensitive drum 1.

Further, the image forming apparatus 100 is provided with an intermediary transfer belt 5, which is an intermediary transferring member for transferring the toner image on the photosensitive drum 1 onto a sheet 12 of recording medium. The intermediary transfer belt 5 is disposed so that it opposes four photosensitive drums 1.

By the way, in this embodiment, the development unit 4 uses nonmagnetic single-component developer, that is, pure toner, as development agent. Also in this embodiment, the development unit 4 develops the electrostatic latent image on the photosensitive drum 1 by placing the development roller 17, which is a developer bearing member, in contact with the photosensitive drum 1 as a developer bearing member (contact development).

In this embodiment, the photosensitive drum 1, and the processing means, more specifically, the charge roller 2, are integrally attached to the development unit frame 14, forming thereby a cleaning unit 13. By the way, referential codes 61 and 86 stand for a waste toner feeding passage, and a waste toner box, respectively, which are described later in detail.

Figure 4:
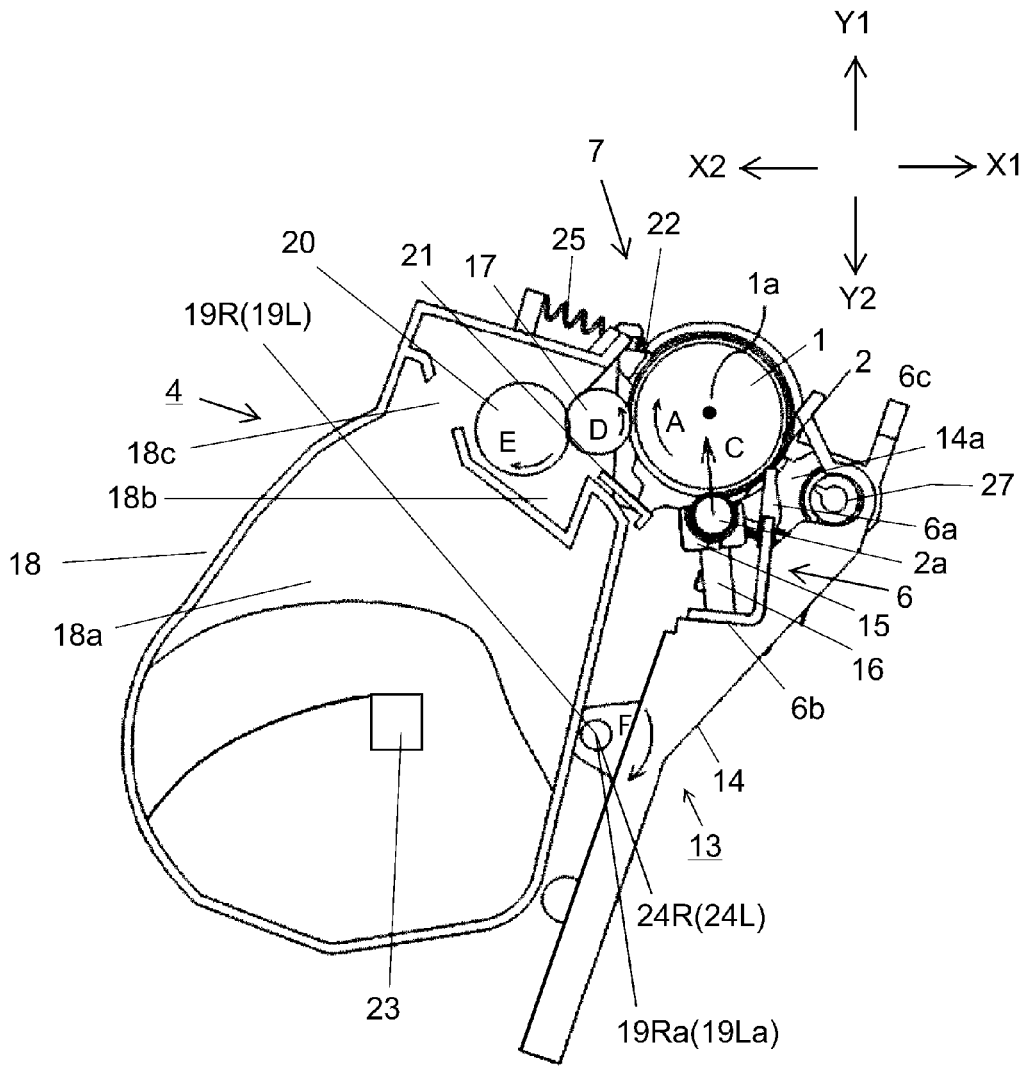
FIG. 4 is a schematic sectional view of the process cartridge, in the first embodiment, equipped with the feeding device which is in accordance with the present invention.

Further, referring to FIG. 4, in this embodiment, the development unit 4 and cleaning unit 13 are integrated as the process cartridge 7, which can be installed into, or uninstalled from, the image forming apparatus 100 by way of unshown installation guide, positioning member, etc., with which the main assembly of the image forming apparatus 100 is provided.

Also in this embodiment, the four process cartridges 7 for the aforementioned four colors, one for one, are the same in shape, and contain yellow (Y), magenta (M), cyan (C) and black (K) toners, one for one.

The intermediary transfer belt 5 is disposed in contact with the photosensitive drum 1. It circularly moves in the direction indicated by an arrow mark B. It is suspended by multiple supporting members (driver roller 51, belt backing roller 52, idler roller 53), in such a manner that it bridges adjacent two supporting members. There are disposed in parallel four primary transfer rollers 8 as primary transferring means, on the inward side of the loop which the intermediary transfer belt 5 forms. The four primary transfer rollers 8 are disposed in a manner to oppose the four photosensitive drums 1, one for one. There is also disposed the secondary transfer roller 9 as the secondary transferring means, on the outward side of the loop which the intermediary transfer belt 5 forms. The secondary transfer roller 9 is disposed in a manner to oppose the belt backing roller 52.

In an image forming operation, first, the peripheral surface of the photosensitive drum 1 is uniformly charged by the charge roller 2. Then, the charged peripheral surface of the photosensitive drum 1 is scanned by (exposed to) a beam of laser light emitted from the scanner unit 3 while being modulated according to the information of the image to be formed. Consequently, an electrostatic latent image, which reflects the information of the image to be formed, is effected on the photosensitive drum 1. Then, the electrostatic latent image on the photosensitive drum 1 is developed by the development unit 4 into a toner image. The four toner images formed on the four photosensitive drums 1, one for one, are transferred (primary transfer) onto the intermediary transfer belt 5 by the function of the primary transfer rollers 8.

In an operation for forming a full-color image, for example, the above-described process is sequentially carried out by the four process cartridges 7. Thus, four monochromatic toner images, different in color, are sequentially transferred in layers onto the intermediary transfer belt 5. Meanwhile, a sheet 12 of recording medium is conveyed to the secondary transferring section in synchronism with the movement of the four toner images on the intermediary transfer belt 5. Then, while the sheet 12 and the toner images, different in color, on the intermediary transfer belt 5 are conveyed through the secondary transferring section, the four toner images are transferred together (secondary transfer) onto the sheet 12 by the function of the secondary transfer roller 9.

After the transfer of the toner images onto the sheet 12 of recording medium, the sheet 12 is conveyed to a fixing device 10 as a fixing means, in which heat and pressure are applied to the sheet 12 and the toner images thereon, whereby the toner images are fixed to the sheet 12. By the way, the primary transfer residual toner, which is the toner remaining on the peripheral surface of the photosensitive drum 1 after the primary transfer, is removed by the cleaning blade 6, and is recovered as waste toner.

The secondary transfer residual toner, which is the toner remaining on the intermediary transfer belt 5 after the secondary transfer process, is removed by an intermediary transfer belt cleaning device 11.

By the way, the image forming apparatus 100 is enabled to form a monochromatic or multi-color image, with the use of only a specific image forming section or two or more (not all of four) of its image forming sections.

(Process Cartridge)

Figure 3:
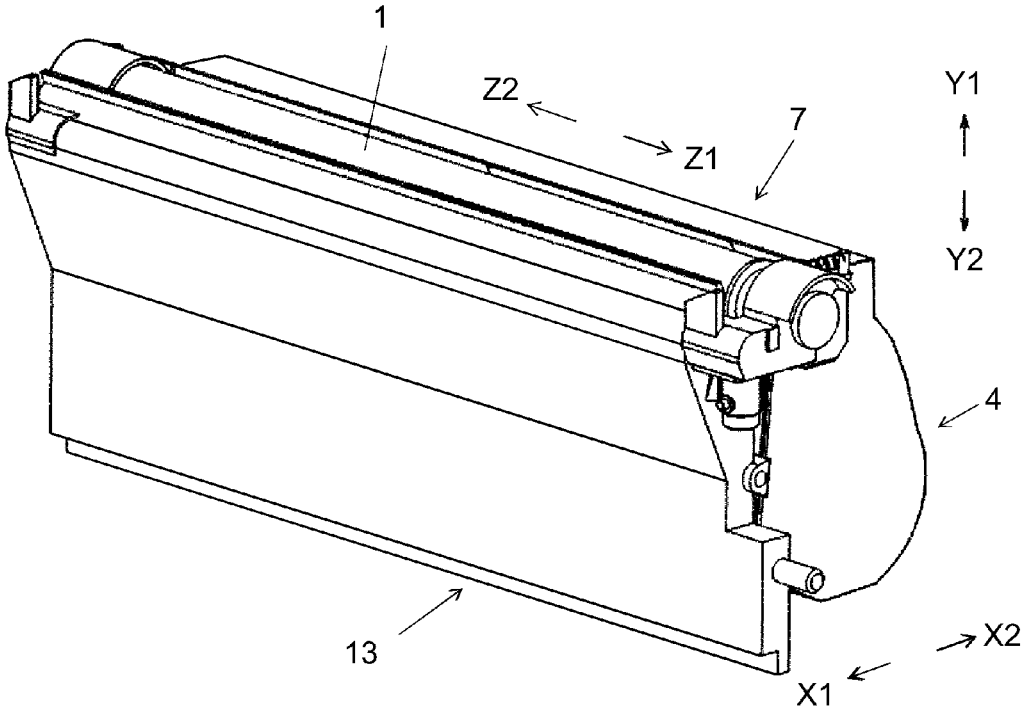
FIG. 3 is an external perspective view of the process cartridge, in the first embodiment, equipped with the feeding device which is in accordance with the present invention.

Next, referring to FIGS. 3 and 4, the process cartridge 7 which is installable (insertable) into the image forming apparatus 100 in this embodiment is described about its overall structure. FIG. 3 is an external perspective view of the process cartridge 7. First, referring to FIG. 3, hereafter, the direction which is parallel to the rotational axis of the photosensitive drum 1 is referred to as direction Z (indicated by arrow marks Z1 or Z2). Next, referring to FIG. 2, the horizontal direction (indicated by arrow mark X1 or X2), and vertical direction (indicated by arrow mark Y1 or Y2), are referred to as directions X and Y, respectively. FIG. 4 is a schematic sectional view of the process cartridge 7 as seen from the direction Z, when the process cartridge 7 is in the image forming apparatus 100 and the photosensitive drum 1 and development roller 17 are in contact with each other.

Referring to FIG. 4, the development unit 4 has a development unit frame 18 which supports various internal members of the development unit 4. The development unit 4 is provided with the development roller 17, as a developer bearing member, which rotates in the direction indicated by the arrow mark D in the drawing (counterclockwise direction), while remaining in contact with the photosensitive drum 1. The development roller 17 is rotatably supported by the development unit frame 18 by its ends in terms of its lengthwise direction (parallel to its rotational axis), with the placement of a pair of development roller bearings 19 (19R and 19L), one for one, between the development roller 17 and the development unit frame 18. In this embodiment, the development roller bearings 19 are attached to the front and rear walls of the development unit frame 18, one for one.

Further, the development unit 4 has a developer storage chamber 18*a* (toner storage chamber), and a development chamber 18*b* in which the development roller 17 is disposed. There are disposed in the development chamber 18*b*, a toner supply roller 20 and a development blade 21. The toner supply roller 20 is a developer supplying member, and rotates in the direction indicated by an arrow mark E while remaining in contact with the development roller 17. The development blade 21 is a developer regulating member for controlling the toner layer on the development roller 17 in thickness. The development blade 21 is attached to a development blade holding member 22, to which it is welded with the use of YAG laser, for example.

Further, there is in the toner storage chamber 18*a* of the development unit frame 18, a stirring member 23 for feeding the toner in the toner storage chamber 18*a* to the toner supply roller 20 while stirring the toner. The development unit 4 is in connection to the cleaning unit 13 in such a manner that it is rotatable about a shaft 24 (24R and 24L) fitted in the holes 19Ra and 19La with which the bearings 19R and 19L, respectively, are provided. Further, the development unit 4 is kept under the pressure generated by a pair of tension springs 25. Thus, as the process cartridge 7 begins to be used for an image forming operation, the development unit 4 rotates in the direction indicated by an arrow mark F about the shafts 25, causing thereby the development roller 17 to come into contact with the photosensitive drum 1.

The cleaning unit 13 has a cleaning unit frame 14 as a frame for supporting various internal members of the cleaning unit 13. The cleaning unit 13 has the cleaning blade 6, a waste toner storing section 14*a* for storing the recovered transfer residual toner, and a waste toner feeding member 27. It is the cleaning unit frame 14 that the photosensitive drum 1 is attached so that the photosensitive drum 1 is rotatable in the direction indicated by an arrow mark A in FIG. 4. Also attached to the cleaning unit frame 14 is a pair of charge roller bearings 15 in such a manner that the rotational axis of the charge roller 2 becomes parallel to the rotational axis of the photosensitive drum 1.

Here, the charge roller 2 is attached to the cleaning unit frame 14 so that they are allowed to move in the direction indicated by an arrow mark C in FIG. 4. The rotational axle 2*a* of the charge roller 2 is rotationally borne by the pair of charge roller bearings 15, which are under the pressure generated by a pair of charge roller pressing springs 16, as pressure applying means, in the direction to press the charge roller 2 toward the photosensitive drum 1.

The cleaning unit frame 14 is provided with the cleaning blade 6 as a cleaning means for removing the toner remaining on the peripheral surface of the photosensitive drum 1 (image bearing member). The cleaning blade 6 integrally comprises an elastic section 6*a* which is placed in contact with the peripheral surface of the photosensitive drum 1 to remove the toner on the photosensitive drum 1, and a metallic section 6*b* for supporting the elastic section 6*a*. The metallic section 6*b* is formed of a sheet of metallic substance. In this embodiment, the supporting section 6*b* is fixed to the cleaning unit frame 14 with the use of small screws.

Here, a vector which is parallel to a tangential line to the peripheral surface of the photosensitive drum 1, and opposite in direction from the direction indicated by the arrow mark A which shows the rotational direction of the photosensitive drum 1, is referred to as a tangential vector. Thus, the photosensitive drum contacting section 6*c* of the cleaning blade 6, that is, the tip of the elastic section 6*a*, is in contact with the photosensitive drum 1, in an area where the tangential vector has an upward component in terms of the vertical direction.

(Waste Toner Feeding)

Figure 1:
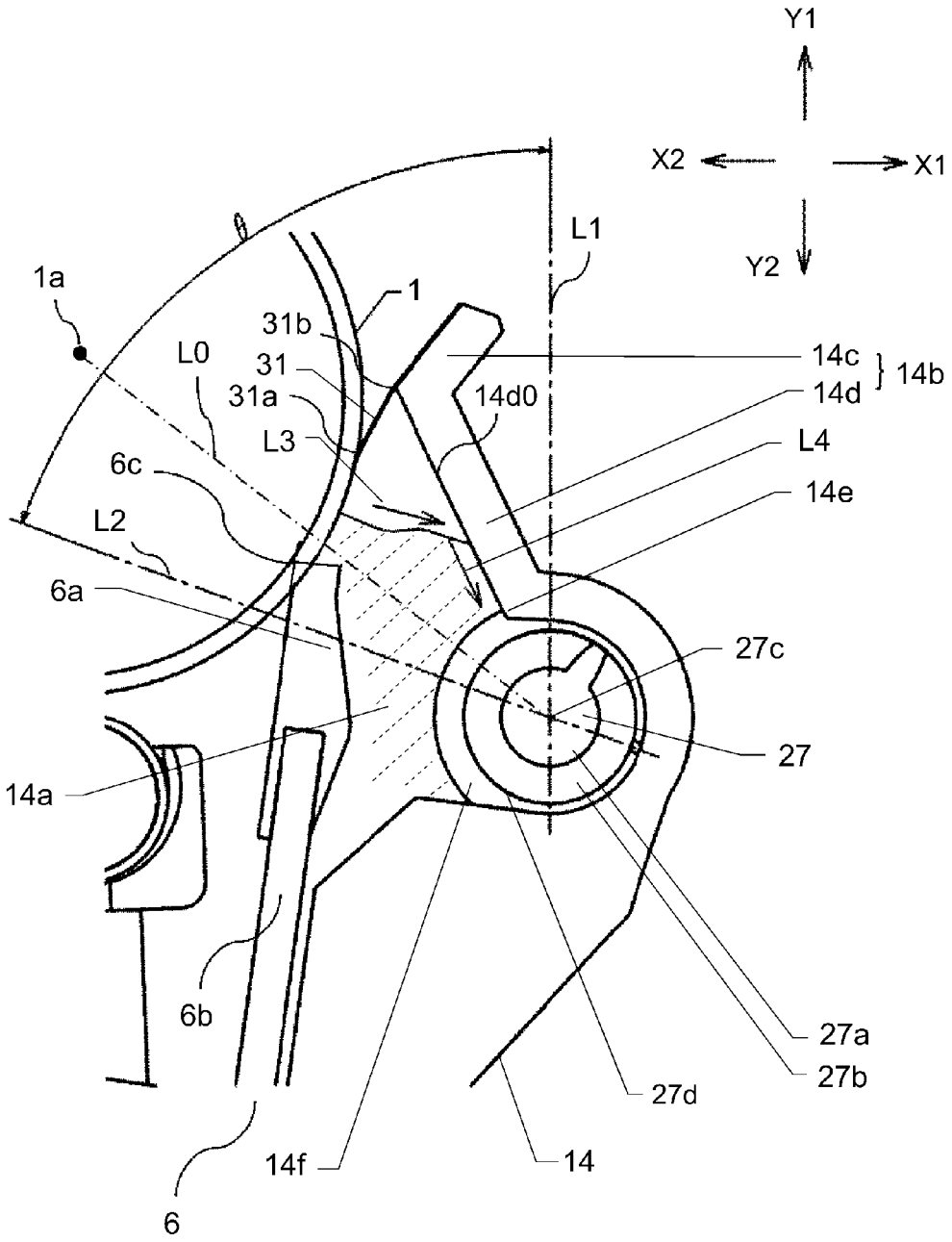
FIG. 1 is a sectional view of the waste toner storage section of the feeding device in the first embodiment of the present invention, which is for describing the structure of the waste toner storage section.
Figure 5:
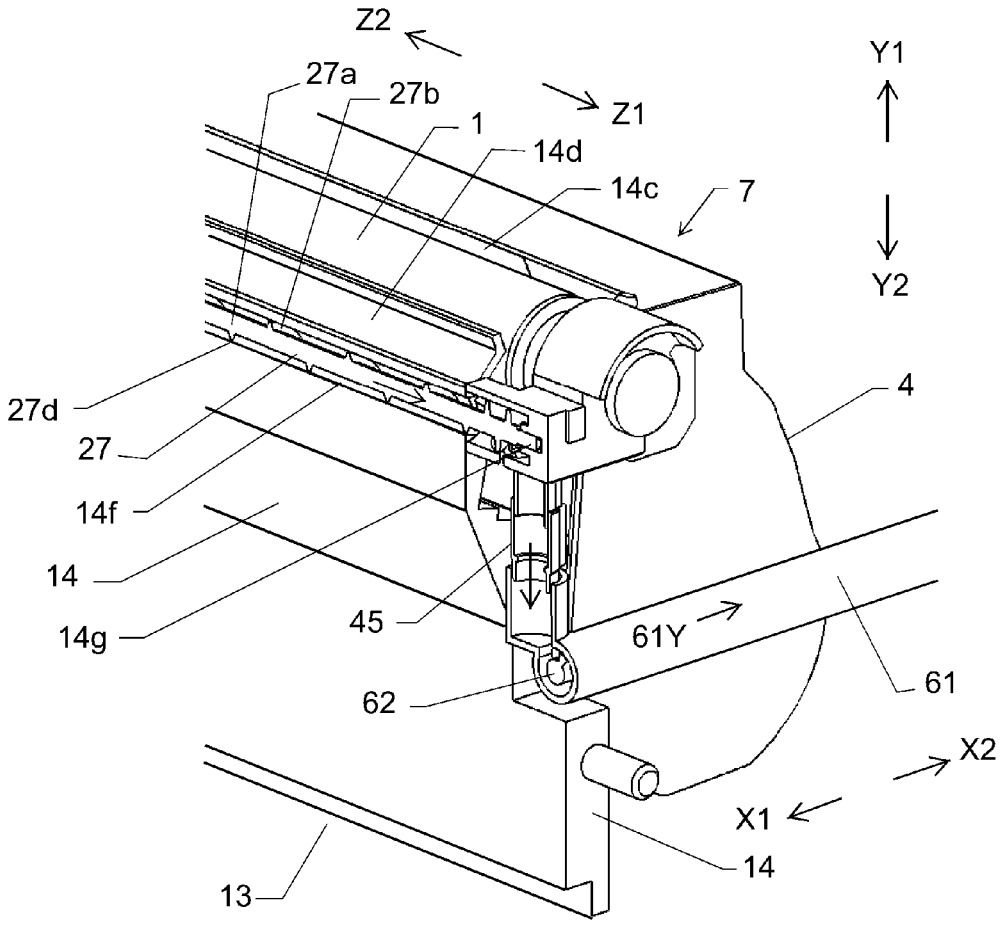
FIG. 5 is a perspective view of the waste toner feeding section of the feeding device in the first embodiment, which is for describing the structure of the waste toner feeding section.

Next, referring to FIGS. 1 and 5, the cleaning unit 13 is described about its waste toner feeding structure in the cleaning unit frame 14. FIG. 1 shows in detail the adjacencies of the photosensitive drum contacting section 6*c* of the cleaning blade 6 shown in FIG. 4. It is a sectional view of the waste toner feeding section of the cleaning unit 13. FIG. 5 is a partially broken perspective view of one of the lengthwise end portions of the process cartridge 7. It is for describing the structure of the lengthwise end portion.

1) Overall Structure of Waste Toner Storage Section 14*a*

In the image forming apparatus, the developer (toner) remaining on the peripheral surface of the photosensitive drum 1 after the primary transfer is removed from the peripheral surface of the photosensitive drum 1 by the cleaning blade 6 (made up of elastic section 6*a*, and supporting section 6*b* which supports elastic section 6*a*), as a cleaning means. That is, the elastic section 6*a* of the cleaning blade 6 removes from the peripheral surface of the photosensitive drum 1, the developer (toner) remaining on the peripheral surface of the photosensitive drum 1, in the area in which the photosensitive drum contacting section 6*c* of the cleaning blade 6 contacts the photosensitive drum 1.

Next, referring to FIG. 1, the cleaning unit frame 14 is provided with the waste toner storage section 14*a* for storing the waste toner removed from the peripheral surface of the photosensitive drum 1 by the elastic section 6*a* of the cleaning blade 6. Thus, the waste toner removed by the photosensitive drum contacting section 6*c* is cumulatively stored in the waste toner storage section 14*a*.

Further, there is provided a waste toner feeding member 27 in the waste toner storage section 14*a*. Next, referring to FIG. 5, the waste toner feeding member 27 has a rotational shaft 27*a* and a spiral feeding blade 27*b*. It is supported by the waste toner feeding member supporting section 14*g*, with which the waste toner storage section 14*a* is provided, so that it can be rotated about the rotational axis 27*c* (FIG. 1) of the waste toner feeding member 27.

Further, the waste toner storage section 14*a* is provided with a waste toner sealing member 31, which is in the form of a piece of sheet and is placed in contact with the photosensitive drum 1 to keep the waste toner storage section 14*a* sealed so that the waste toner in the waste toner storage section 14*a* does not leak.

The waste toner storage section 14*a* has a wall section 14*b* (FIG. 1) for preventing the waste toner from leaking from the cleaning unit frame 14, a waste toner seal supporting section 14*c* by which a waste toner sealing member 31 is supported, and a waste toner guiding section 14*d* which guides the waste toner. The waste toner guiding section 14*d* is has an inward surface 14*d*0 which is a part of the inward surface of the waste toner storage section 14*a* and serves as a waste toner guiding section. Moreover, the waste toner storage section 14*a* has a waste toner feeding passage 14*f* (FIGS. 1 and 5) in which the waste toner feeding member 27 is disposed.

As described above, in this embodiment, the waste toner sealing member 31 is adhered to the waste toner sealing member supporting section 14*c* with the use of a piece of two-sided adhesive tape. Next, referring to FIG. 1, by the way, a referential code 31*a* stands for the area of contact between the waste toner sealing member supporting member 31 and photosensitive drum 1, and a referential code 31*b* stands for the connective section of the waste toner sealing member 31, by which the waste toner sealing member 31 is connected to the waste toner sealing member supporting section 14*c*.

2) Angle of Inward Surface 14*d*0 of Waste Toner Guiding Section 14*d*

In this embodiment, the inward surface 14*d*0 of the waste toner guiding section 14*d* is provided with such an angle that is described next. First, referring to FIG. 1, a straight line which coincides with the rotational axis 27*c* of the waste toner feeding member 27, and is parallel to the direction Y, or the vertical direction, is referred to as the first straight line L1. Further, a straight line which coincides with the rotational axis 27*c* of the waste toner feeding member 27, and is parallel to the angle of repose of the waste toner is referred to as the second straight line L2. Here, "angle of repose" means the angle of the lateral surface of a body of toner, relative to a horizontally placed piece of flat plate, at the moment when a body, which toner forms as it is made to vertically fall down onto a horizontally placed piece of flat plate, begins to naturally collapse.

Referring to FIG. 1, in this embodiment, the inward surface 14*d*0 of the waste toner guiding section 14*d* has such an angle that its angle relative to the horizontal surface is no less than the angle of the second straight line L2, and no more than the angle of the first straight line L1. That is, the inward surface 14*d*0 extends in the direction which is between the first straight line L1 and second straight line L2 which form an acute angle (θ). Since the inward surface 14*d*0 of the waste toner guiding section 14*d* is given an angle which is greater than the angle of repose of the developer (toner), it is possible to ensure that the waste toner is reliably guided to the waste toner feeding member 27.

Further, in this embodiment, the inward surface 14*d*0 of the waste toner guiding section 14*d* extends straight in the direction indicated by an arrow mark L4, which indicates also the direction in which the waste toner moves from the waste toner sealing member supporting section 14*c* to the waste toner feeding member 27. That is, the cleaning unit frame 14 is structured to make the inward surface 14*d*0 of the waste toner guiding section 14*d* tilted so that the closer it is to the waste toner feeding member 27, the narrower the distance between the inward surface 14*d*0 and a straight line L0 (straight line which coincides with rotational axis 1*a* of photosensitive drum 1 and rotational axis 27*c* of waste toner feeding member 27). In other words, the closer it is to the waste toner feeding member 27, the narrower the waste toner storage space of the waste toner storage section 14*a*. Therefore, it is ensured that the waste toner is reliably guided to the waste toner feeding member 27.

3) Position of Bottom End of Inward Surface 14*d*0 of Waste Toner Guiding Section 14*d* in Terms of Vertical Direction In this embodiment, the cleaning blade 6 is disposed so that the area of contact (photosensitive drum contacting section 6*e* of the cleaning blade 6) between the elastic section 6*a* and photosensitive drum 1 is positioned higher than the bottom end 14*e* of the inward surface 14*d*0 of the waste toner guiding section 14*d* in terms of the vertical direction. Therefore, it is prevented that the developer (waste toner) remains in the adjacencies of the photosensitive drum contacting section 6*c*, and fails to be conveyed.

4) Position of Area of Contact 6*c* Between Elastic Section 6*a* and Photosensitive Drum 1

It is desired that the development unit 4 is structured so that the area of contact 6*c* between the elastic section 6*a* and photosensitive drum 1 is positioned within the space between the above-described the first and second straight lines L1 and L2 which form an acute angle (θ). In this embodiment, the development unit 4 is structured so that the area of contact 6*c* is positioned on the opposite side of the straight line L0 (which coincides with rotational axis 1*a* of photosensitive drum 1, and rotational axis 27*c* of waste toner feeding member 27), from the waste toner sealing member 31.

5) Movement of Waste Toner in Waste Toner Storage Section 14*a*

As described above, the waste toner removed by the photosensitive drum contacting section 6*c* is accumulated in the waste toner storage section 14*a*. As a printing operation is continued, the photosensitive drum 1 is repeatedly scraped by the cleaning blade 6, whereby the waste toner is scraped away from the peripheral surface of the photosensitive drum 1, and accumulates in the waste toner storage section 14*a*. Then, the waste toner having accumulated in the waste toner storage section 14*a* is conveyed by the pressure from the additional (new supply of) waste toner from the area of contact 6*c*, in the direction indicated by an arrow mark L3 in FIG. 1. As the waste toner in the waste toner storage section 14*a* is conveyed in the direction indicated by the arrow mark L3, it comes into contact with the inward surface

14*d*0 of the waste toner guiding section 14*d*, whereby it is guided in the direction indicated by an arrow mark L4 in FIG. 1.

6) Waste Toner Feeding by Waste Toner Feeding Member 27

As the waste toner is guided in the above-described direction indicated by the arrow mark L4, it comes to the largest diameter section 27*b*1 of the spiral feeding blade 27*b*, which is greater in diameter than the shaft portion 27*a* of the waste toner feeding member 27, and is conveyed by the waste toner feeding member 27 which has the shaft portion 27*a* and spiral feeding blade 27*b*. Then, as the waste toner feeding member 27 continues to rotate, the waste toner is conveyed in the direction indicated by an arrow mark Z1 (FIGS. 3 and 5) by the spiral feeding blade 27*b*.

As the waste toner is conveyed in the direction indicated by the arrow mark Z1 (FIGS. 3 and 5), it falls in the direction indicated by an arrow mark Y2, through a through hole 45, with which one of the lengthwise end portions of the process cartridge is provided, and which connects the waste toner feeding passage 14*f* and the feeding passage 61 of the apparatus main assembly. Then, as the waste toner lands in the feeding passage 61 of the apparatus main assembly, it is conveyed in the direction indicated by an arrow mark 61Y in FIG. 5, by the waste toner feeding member 62 of the apparatus main assembly, which is provided in the feeding passage 61, and ends up being discharged into the waste toner box 86 (FIG. 2) of the apparatus main assembly.

Effects of this Embodiment

As described above, the development unit 4 is structured so that the inward surface 14*d*0 of the waste toner guiding section 14*d* is positioned in the space between the first and second straight lines L1 and L2, and extends in the direction indicated by the arrow mark L4, in which the waste toner moves from the waste toner sealing member supporting section 14*c* to the waste toner feeding member 27. Thus, it is ensured that the waste toner is reliably guided to the waste toner feeding member 27. Therefore, it is ensured that the waste toner is desirably conveyed in the waste toner storage section 14*a*, in the direction indicated by the arrow mark Z1 (FIGS. 3 and 5).

Since it is ensured that the waste toner is reliably conveyed in the direction indicated by the arrow mark Z1 (FIGS. 3 and 5), it is possible to prevent the waste toner removed from the peripheral surface of the photosensitive drum 1, in the area of contact 6*c* between the cleaning blade 6 and photosensitive drum 1, from accumulating by an excessive amount in the adjacencies of the area of contact 6*c*. Therefore, it is possible to prevent the waste toner storage section 14*a* from being punctured by the waste toner. By preventing the waste toner storage section 14*a* from being punctured by the waste toner, it is possible to prevent the waste toner feeding member 27 from excessively increasing in the amount of torque necessary to rotate the waste toner feeding member 27, and also, to prevent the waste toner from leaking from the development unit 4 through the area of contact between the waste toner sealing member 31 and photosensitive drum 1.

Modifications of First Embodiment

In the foregoing, one of the preferred embodiments of the present invention was described. However, the above-described embodiment is not intended to limit the present invention in scope. That is, the embodiment is variously modifiable within the scope of the present invention. By the way, the preceding embodiment is not intended to limit the image forming apparatus and its developing device in terms of the function, material, and shape of their structural members, and also, the positional relationship among the structural members, unless specifically noted.

(Modification 1)

In the above-described embodiment, the feeding device which includes the waste toner feeding section 27 for feeding the developer was disposed within the process cartridge which is insertable in the main assembly of the image forming apparatus. However, the present invention is applicable also to an image forming apparatus, which does not employ a process cartridge, and the feeding device of which is within the main assembly of the apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-037861 filed on Feb. 27, 2015, which is hereby incorporated by reference herein in its entirety.

What is claimed is:

1. A feeding device for feeding a developer, said feeding device comprising:

a cleaning member configured to be in contact with an image bearing member for carrying a developer image to remove a developer from the image bearing member;

an accommodating portion configured to accommodate the developer removed by said cleaning member;

a feeding member including a rotational shaft and a spiral feeding blade and configured to feed the developer from said accommodating portion;

a sheet fixed to said accommodating portion and contacted to the image bearing member; and a guiding portion extending toward said feeding member and forming a part of a wall surface of said accommodating portion at a position on a side where said sheet is provided, with respect to a line connecting a rotation center of the image bearing member and a rotation center of said feeding member, as viewed in an axial direction of the image bearing member when the feeding device is attached to the image bearing member, wherein relative to a horizontal orientation, said guiding portion is inclined at a first angle that is greater than an angle of repose of the developer and less than 90°, and wherein an imaginary extension of said guiding portion in a cross-section perpendicular to the axial direction of the image bearing member passes through said rotational shaft, and as said guiding portion approaches said feeding member, a distance between said guiding portion and a line which extends vertically through the rotation center of the feeding member decreases.

2. A feeding device according to claim 1, wherein a position of contact between the image bearing member and said cleaning member is in such a zone that a tangent line vector at the contact position in a direction opposite to a rotational moving direction of the image bearing member has an upward component with respect to a vertical direction.

3. A feeding device according to claim 1, wherein a position of contact between the image bearing member and said cleaning member is in an area within an angle range between the first angle and a horizontal orientation at the rotation center of said feeding member.

4. A feeding device according to claim 3, wherein the position of contact between the image bearing member and said cleaning member is on a side opposite from the side on which said sheet is disposed with respect to the line connecting the rotation center of the image bearing member and the rotation center of said feeding member.

5. A feeding device according to claim 1, wherein the rotation center of said feeding member is disposed below the rotation center of the image bearing member.

6. A feeding device according to claim 5, wherein the rotation center of said feeding member is below a position of contact between the image bearing member and said cleaning member.

7. A feeding device according to claim 6, wherein the rotation center of the image bearing member is above the position of contact between the image bearing member and said cleaning member.

8. A feeding device according to claim 1, wherein said guiding portion is linear as viewed in the direction of the axial direction of the image bearing member.

9. A feeding device according to claim 1, wherein said guiding portion is provided in a frame supporting the image bearing member.

10. A feeding device according to claim 1, wherein a position of contact between said cleaning member and the image bearing member is above a lower end portion of said guiding portion.

11. A feeding device according to claim 1, wherein a position of contact between said cleaning member and the image bearing member is below a position of contact between said sheet and the image bearing member.

12. A cleaning device for cleaning an image bearing member, comprising a feeding device according to claim 1.

13. A process cartridge detachably mountable to a main assembly of an image forming apparatus, said process cartridge comprising:

a cleaning device according to claim 12; and the image bearing member configured to carry a developer image.

14. An image forming apparatus comprising:

a cleaning device according to claim 12, provided in a process cartridge or in a main assembly of the apparatus;

the image bearing member, provided in the process cartridge or in the main assembly of the apparatus and configured to carry a developer image; and an exposure device provided in the main assembly of the apparatus and configured to form an electrostatic latent image on said image bearing member.

15. A process cartridge detachably mountable to a main assembly of an image forming apparatus, said process cartridge comprising:

a feeding device according to claim 1; and the image bearing member, configured to carry a developer image.

16. An image forming apparatus comprising:

a feeding device according to claim 1, provided in a process cartridge or in a main assembly of the apparatus;

the image bearing member, provided in the process cartridge or in the main assembly of the apparatus and configured to carry a developer image; and an exposure device provided in the main assembly of the apparatus and configured to form an electrostatic latent image on the image bearing member.

* * * * *